US008112954B2

(12) United States Patent
Gosling et al.

(10) Patent No.: US 8,112,954 B2
(45) Date of Patent: Feb. 14, 2012

(54) LOCK AND SEAL SYSTEM FOR SLIDING DOORS

(75) Inventors: Geoff Gosling, Calgary (CA); Mogens F. Smed, DeWinton (CA); Thomas Alfred Brown, Calgary (CA); Steven M. van Beveren, Calgary (CA)

(73) Assignee: Dirtt Environmental Solutions Ltd., Alberta (CA)

( * ) Notice: Subject to any disclaimer, the term of this patent is extended or adjusted under 35 U.S.C. 154(b) by 605 days.

(21) Appl. No.: 12/135,027

(22) Filed: Jun. 6, 2008

(65) Prior Publication Data

US 2008/0302021 A1 Dec. 11, 2008

Related U.S. Application Data

(60) Provisional application No. 60/942,919, filed on Jun. 8, 2007.

(51) Int. Cl.
*E05C 1/00* (2006.01)
*E06B 1/52* (2006.01)

(52) U.S. Cl. ..... 52/207; 52/205; 52/211; 70/99; 70/100; 49/449; 49/209; 292/137; 292/138; 292/340; 292/DIG. 46

(58) Field of Classification Search ..... 52/745.16, 52/204.1, 205, 207, 211, 243; 70/96, 97, 70/98, 99, 100; 49/449, 410, 411, 209; 292/340, 292/341, 137, 138, 139, 141, 143, DIG. 46
See application file for complete search history.

(56) References Cited

U.S. PATENT DOCUMENTS

| | | | | | |
|---|---|---|---|---|---|
| 595,505 | A * | 12/1897 | Wesling | 292/167 |
| 1,142,463 | A * | 6/1915 | Shepherd | 292/40 |
| 1,271,363 | A * | 7/1918 | Ralston | 292/138 |
| 4,500,122 | A * | 2/1985 | Douglas | 292/161 |
| 4,514,996 | A * | 5/1985 | Sjogren | 70/100 |
| 4,643,005 | A * | 2/1987 | Logas | 70/95 |
| 4,694,669 | A * | 9/1987 | Schwalb | 70/100 |
| 4,884,376 | A * | 12/1989 | DeBlock et al. | 52/92.2 |
| 4,944,169 | A * | 7/1990 | Labelle et al. | 70/100 |
| 5,359,816 | A * | 11/1994 | Iacouides | 52/274 |
| 5,371,987 | A * | 12/1994 | Hirsch et al. | 52/207 |
| 5,590,919 | A * | 1/1997 | Germano | 292/137 |
| 6,637,781 | B1 * | 10/2003 | Seymour, II | 285/305 |
| 6,826,867 | B1 * | 12/2004 | McDonald et al. | 49/213 |
| 6,883,281 | B1 * | 4/2005 | Chavez-Gandara | 52/284 |
| 2005/0150169 | A1 * | 7/2005 | Schulte et al. | 49/410 |
| 2006/0032161 | A1 * | 2/2006 | Kalempa et al. | 52/204.1 |
| 2006/0192394 | A1 * | 8/2006 | Cennamo | 292/139 |
| 2007/0175121 | A1 * | 8/2007 | Speyer et al. | 52/207 |

* cited by examiner

*Primary Examiner* — Brian E. Glessner
*Assistant Examiner* — Jessie Fonseca
(74) *Attorney, Agent, or Firm* — Workman Nydegger

(57) ABSTRACT

Implementations of the present invention relate generally to systems and components for sealing and locking doors, including sliding doors for use with modular walls. A locking system can be configured to secure and release a sliding door. In particular, the locking system can include a sliding door with one or more receiving channels configured to receive a pin extending from a floor's surface. A locking mechanism can be included and configured to selectively drive a shaft to capture and release a pin that has been received by the receiving channel. The sealing system is configured to seal a gap between a modular wall and an adjacent sliding door. In particular, the sealing system can include a connector configured to connect trim to a wall panel wherein the connector includes an integrated gasket seal configured to seal the gap.

13 Claims, 3 Drawing Sheets

LOCK AND SEAL SYSTEM FOR SLIDING DOORS

CROSS-REFERENCE TO RELATED APPLICATIONS

This application claims the benefit of U.S. Provisional Patent Application Ser. No. 60/942,919, filed Jun. 8, 2007, entitled "LOCK AND SEAL SYSTEM FOR SLIDING DOORS," the entire contents of which are incorporated herein by reference.

BACKGROUND OF THE INVENTION

1. The Field of the Invention

Implementations of the present invention relate generally to systems and components for sealing and locking doors, including sliding doors for use with modular walls.

2. Background and Relevant Art

Office space can be relatively expensive, not only due to the basic costs of the location and size of the office space, but also due to any construction needed to configure the office space in a particular way. For example, an organization might purchase or rent a large open space in an office complex, and then subdivide or partition the open space into various offices, conference rooms, or cubicles, depending on the organization's needs and size constraints. Rather than having to find new office space and move as an organization's needs change, it is often necessary to have a convenient and efficient means to reconfigure the existing office space. Many organizations address their configuration and reconfiguration issues by dividing large, open office spaces into individual work areas using modular walls and partitions.

In particular, at least one advantage of modular systems is that they are relatively easy to configure. In addition, another advantage is that modular systems can be less expensive to set up, and can be reconfigured more easily than more permanently constructed office dividers. For example, a set of offices and a conference area can be carved out of a larger space in a relatively short period of time with the use of modular systems. If needs change, the organization can readily reconfigure the space.

In general, modular office partitions typically include a series of individual wall modules (and/or panels). The individual wall modules can either be free-standing or rigidly attached to one or more support structures. In addition, the wall modules are typically designed so that they can be assembled together to form a range of different configurations. In particular, a manufacturer or assembler can usually align and join the various wall modules together in almost any particular design, and then secure the design in place with any number of fasteners. These designs can include anything from large conference spaces to individual offices. A "finished" look is generally completed by adding gaskets or trim pieces in the joints between wall modules.

One will appreciate that modular wall systems may also include door openings to allow a person to enter and exit rooms or other enclosures defined by the modular wall systems. Closure apparatuses, such as doors, can facilitate opening and closing the door openings. In some cases, a manufacturer or designer will opt for a conventional swinging door, while in other cases, the manufacturer might opt for a sliding door configuration, whether for various aesthetic or space-saving purposes.

As will be appreciated, it is often desirable to isolate rooms and other enclosures created by modular systems from light and/or sound from outside sources. Gaps associated with doors, however, are often difficult to seal because doors open and close, and lack a static location to seal. This tends to be true for sliding doors used in modular wall systems as well in that gaps between a sliding door and a movable wall panel may be difficult to seal.

In the past, modular wall system manufacturers have placed astragal or other sealing beads along the lead edge of sliding doors to provide a seal between the sliding door and a surface with which the sliding door comes into contact when closed, whether that contact is with another door or a movable wall. Although this approach may provide a successful seal along the lead edge of the sliding door when the door is closed, it does not provide a seal elsewhere around the perimeter of the sliding door, and it requires the door to be fully closed to function properly. Furthermore, such sealing devices remain visible when the door is open, and may be unsightly.

One will appreciate that regardless of the type of door used, it is often desirable to secure doors in an open or closed position. For example, one may wish to secure a door in a closed position in order to secure a room and any articles contained therein. One will also appreciate that securing doors and spaces in a modular wall system presents a particularly difficult challenge due to the reconfigurable and non-permanent nature of the modular wall system. For example, it may be difficult to secure a sliding door used in conjunction with a modular wall system if the sliding door does not interface with a permanent structure.

To address the need to secure doors used in modular wall systems, conventional modular wall systems incorporate latches that may be located along the top or bottom of the sliding door. The latches may engage features in the floor or ceiling, such as holes. In order to engage the latch, the person must either reach down to turn a thumb lock (or similar device) along the bottom of the door, or reach up to the top of the door to engage a similar mechanism. In addition to being difficult to engage, such devices often do not provide a secure and stable position for the door.

Accordingly, these are a number of difficulties with securing and sealing doors in modular environments that can be addressed.

BRIEF SUMMARY OF THE INVENTION

Implementations of the present invention overcome one or more problems in the art with systems, methods, and apparatuses configured to provide flexibility in the design of modular wall systems including sliding doors. In particular, implementations of the present invention provide for aligning and locking a sliding door in place, while simultaneously providing a non-obtrusive sealing mechanism between the door and other components.

For example, a locking system is provided including a sliding door having one or more receiving channels. The receiving channels can be configured to receive a pin extending from a support surface. The sliding door can further comprise a locking mechanism configured to selectively capture the pin when received by the receiving channel. In at least one implementation, the operating means of the locking mechanism can be located near a standard handle location to facilitate operation of the locking mechanism by a user. As a result, a user can operate the locking mechanism to capture the pin within the receiving channel and thereby secure the sliding door in a closed position.

In addition, a sealing system, in accordance with an implementation of the present invention, for sealing a gap between a modular wall and an adjacent sliding door can include a sliding door coupled to the modular wall. The sliding door can be configured to open and close a doorway in the modular wall. In at least one implementation, the sliding door can define one or more transverse gaps between the sliding door and the modular wall. In particular, the transverse gaps can be perpendicular to the direction of travel of the sliding door. A gasket seal can be coupled to the modular wall and configured to seal the transverse gaps.

A further implementation can include a method of providing a locking and sealing system for a sliding door. In particular, the method can include identifying a doorway in a modular wall system and coupling a sliding door to the doorway, for opening and closing the doorway. The sliding door can include one or more receiving channels. The receiving channels can be configured to receive a pin extending vertically from a support surface. In addition, the sliding door can include a locking mechanism configured to selectively drive a shaft to capture and release the pin when received by the receiving channel. In at least on implementation of the present invention, the method can include attaching the pin to a support surface proximate the doorway. In addition, the pin can be configured to engage the receiving channel of the sliding door when the sliding door is in a closed position. In a further implementation, the method can include coupling a gasket seal to a modular wall. The gasket seal can be configured to seal one or more transverse gaps between the sliding door and the modular wall when the sliding door is in a closed position.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention extends to systems for locking and sealing sliding doors in a modular wall environment. In particular, implementations of the present invention provide for aligning and securing a sliding door (or "barn door") in place, while simultaneously providing a non-obtrusive sealing mechanism between the door and other components.

As will be more fully understood herein, the sliding door of the system can include a receiving channel configured to receive a pin. An assembler can couple the pin of the system to a support surface proximate the door, such as a floor or ceiling. In addition, the system can include a locking mechanism configured to capture a pin that has engaged the receiving channel in order to secure the sliding door in a closed position. The locking mechanism can include an operating means located at a standard door handle height, so that a user can conveniently lock and unlock the door without having to bend down or reach up to engage the locking mechanism.

In addition, the system can include a means for sealing a gap between a sliding door and other components. For example, the system can include a sealing gasket configured to seal a gap between the sliding door and an adjacent modular wall. The sealing gasket can be integrated into an existing component, such as a connecting extrusion configured to connect a vertical trim to a modular wall, thereby reducing the quantity of parts required for the entire assembly. In addition, the sealing gasket can be attached to the modular wall, rather than the door itself, which can improve the aesthetics of the system, as well as provide the functional benefit of an improved light and sound barrier between modular spaces separated by the sliding door.

Figure 1:
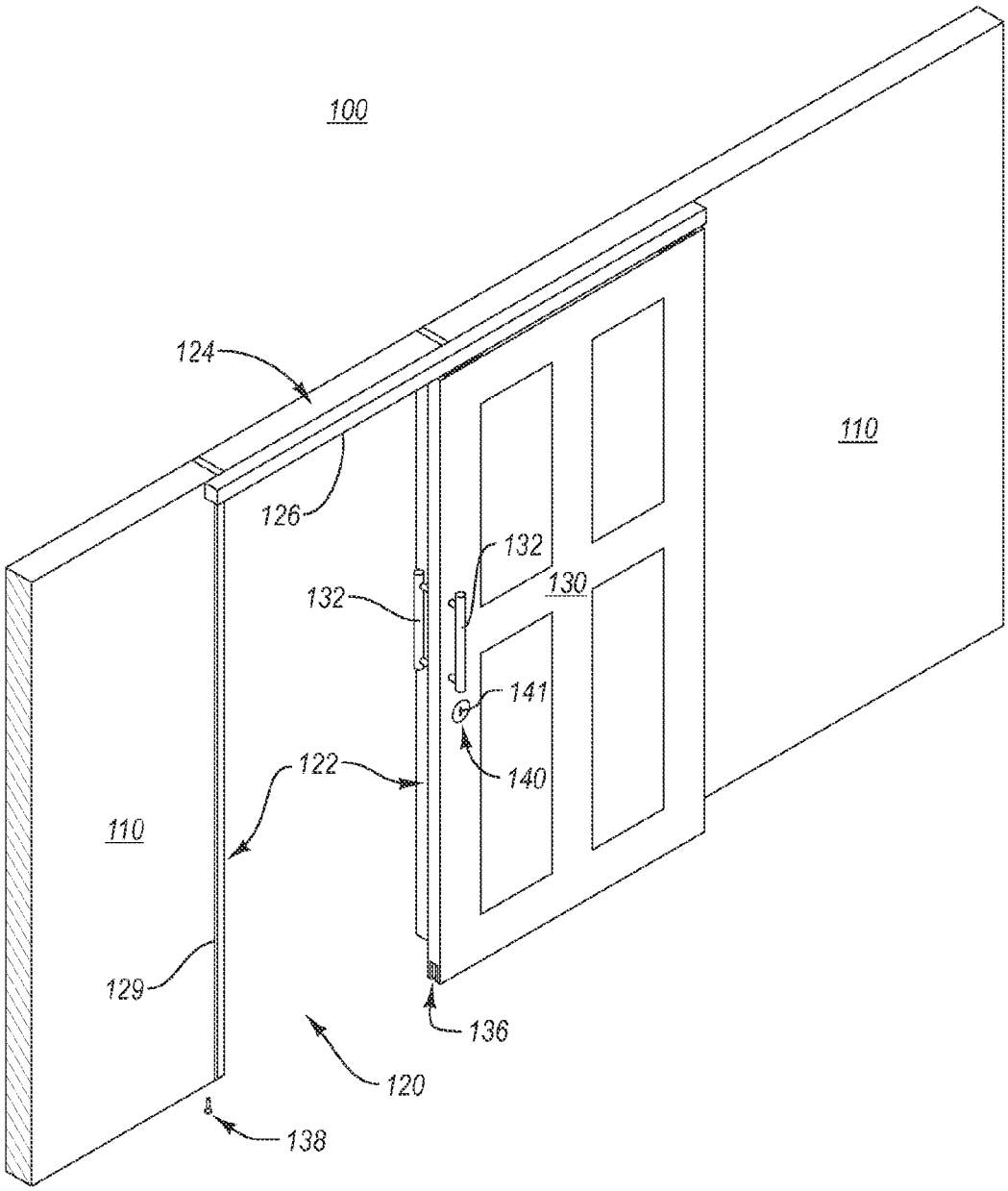
FIG. 1 illustrates an elevation view of a lock and seal system for sliding doors in accordance with an implementation of the present disclosure.

Referring now to the Figures, FIG. 1 illustrates an elevation view of a locking and sealing system 100 according to at least one implementation of the present invention. As shown in FIG. 1, the locking and sealing system 100 can be practiced in an architectural design environment including one or more modular walls 110. One will appreciate that an assembler/manufacturer of modular wall systems may desire to include a doorway 120 in a modular wall 110 so as to allow exit and entry into a modular space defined, at least in part, by the modular wall 110. In order to improve the aesthetics of the doorway 120, an assembler/manufacturer can include framing components such as vertical trim 122 coupled to the exposed vertical edges of the modular wall 110 and/or a doorframe header 124 spanning the upper portion of the doorway 120.

As further illustrated in FIG. 1, an assembler can associate a sliding door 130 with the doorway 120. In particular, the assembler can configure the sliding door 130 to open and close the doorway 120 as desired by a user of the system 100. To facilitate opening and closing the sliding door 130, the assembler can couple a door pull 132 to a left or right side of the sliding door 130 with respect to the doorway 120. Accordingly, a user can operate the door pull 132 to open and close the sliding door 130 as desired.

To further facilitate opening and closing the sliding door 130, the system can include a mounting track 126 coupled to the modular wall 110 and/or doorframe header 124. An assembler can then insert the mounting hardware (not shown) of the sliding door 130 into the mounting track 126 in order to couple the sliding door 130 to the mounting track 126. In at least one implementation, an assembler/manufacturer can configure the mounting track 126 for sliding the sliding door 130 along the mounting track 126 in order to open and close the doorway 120. For example, in at least one implementation, the mounting track 126 can include a roller track configured to receive and allow travel along the mounting track 126 of rollers coupled to the sliding door 130.

In the illustrated example of FIG. 1, the sliding door 130 has a left "handed" configuration. In other words, a user operates the door pull 132 located on the left side of the sliding door 130 and slides the sliding door 130 from left to right to open the sliding door 130. One will appreciate, however, that an assembler or manufacturer can practice the present invention using a door with either a left or right handed door configuration.

As shown in FIG. 1, the system 100 can include a pin 138 extending from a support surface proximate the doorway 120. In the illustrated example, the pin 138 extends from a support surface of the floor. One will appreciate, however, that the pin 138 can extend from any nearby support surface, such as that of a ceiling. In addition, in at least one implementation, the pin 138 can extend from the mounting track 126 itself Accordingly, although FIG. 1 illustrates the receiving channel 136 being located along the bottom edge of the sliding door 130 to coincide with the location of the pin 138 on the support surface of the floor, one will appreciate that the receiving channel can be located at any location along an edge of the sliding door 130 to correspond with the location of the pin 138. For example, a manufacturer can locate the receiving channel 136 near the top edge of the sliding door 130 if the pin 138 is configured to extend from the mounting track 126 or from a support surface of the ceiling. In any event, a manufacturer can form the pin 138 using any number of materials, including metallic and plastic materials. In at least one implementation, for example, a manufacturer can form the pin 138 using an alloy steel.

FIG. 1 further illustrates that a manufacturer can configure the pin 138 to engage a receiving channel 136 associated with the sliding door 130. In at least one implementation of the present invention, the pin 138 engages the receiving channel 136 when the sliding door 130 is in a closed position. An assembler can further configure the pin 138 and the receiving channel 136 to achieve a desired alignment of the sliding door 130 when the sliding door 130 is in a closed position.

In at least one implementation, the system 100 can further comprise a locking mechanism 140 coupled to the sliding door 130. In particular, a manufacturer can configure the locking mechanism 140 to capture the pin 138 once it engages the receiving channel 136. As a result, a user can secure the sliding door 130 in a closed position by sliding the sliding door 130 until the pin 138 engages the receiving channel 136 and then operating the locking mechanism 140 to capture the pin 138 within the receiving channel 136.

The locking mechanism 140 of the present invention can comprise an operating means. In at least one implementation, the operating means comprises a pin tumbler lock 141, also known as a key tumbler lock. In particular, as illustrated in FIG. 1, a manufacturer can locate the pin tumbler lock 141 of the locking mechanism 140 at a location near the door pull 132 of the sliding door 130 so as to facilitate operation of the locking mechanism 140 by a user.

In at least one implementation, the assembler can couple the pin tumbler lock to a tie rod (not shown) extending from the location of the pin tumbler lock 141 to a point near the receiving channel 136. As a result, a manufacturer can couple the tie rod to a shaft (e.g., 142, FIGS. 2A-2D) configured to capture and release the pin 138. Accordingly, once the pin 138 engages the receiving channel 136, a user can operate the locking mechanism 140 to lower the shaft and prevent the pin 138 from disengaging the receiving channel 136, thereby securing the sliding door 130 in a closed position.

Although the system 100 illustrated in FIG. 1 is configured for securing the sliding door 130 in a closed position, one will appreciate that a manufacturer can alternatively configure the system 100 to secure the sliding door 130 in an open position if desired. For example, the manufacturer can locate the receiving channel 136 and the pin 138 on the opposite side of the sliding door 130 with respect to the doorway 120, and further configure the pin 138 to engage the receiving channel 136 when the sliding door 130 is in an open position.

As previously mentioned, a manufacturer can configure the system 100 to include multiple pins 138 and receiving channels 136 on opposite sides of the sliding door 130 such that the sliding door 130 can be secured in either an open or closed position with respect to the doorway 120. Furthermore, a manufacturer can include pins 138 near a top and bottom of the doorway 120 to simultaneously engage multiple receiving channels 136 near a top and bottom of the sliding door 130. To facilitate the use of multiple receiving channels 136, the locking mechanism 140 can further comprise multiple tie rods extending from the operating means to the multiple receiving channels 136 in order to capture and release multiple pins 138. In a further embodiment, the sliding door 130 can include multiple locking mechanisms 140 to interact with the multiple receiving channels 136 and pins 138.

Figure 2A:
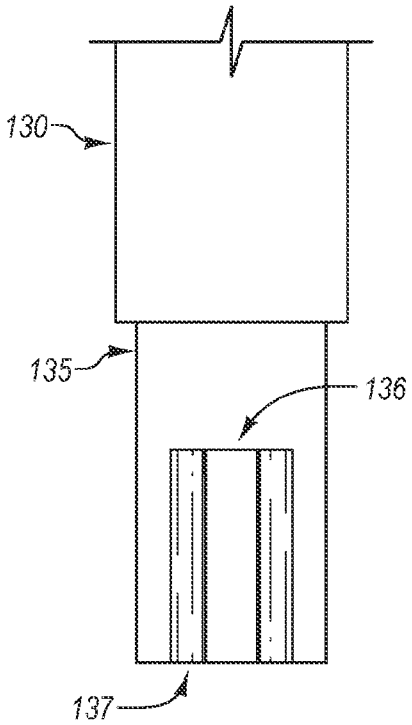
FIG. 2A illustrates a first step of the operation of a locking system in accordance with an implementation of the present disclosure.

These and other components/mechanisms for locking the sliding door 130 are shown in greater detail in FIGS. 2A-2D. For example, FIGS. 2A-2D illustrate step by step views of a pin 138 engaging the receiving channel 136 of a sliding door 130. In particular, FIG. 2A illustrates a receiving channel 136 of a sliding door 130 prior to engaging a pin 138. In at least one implementation, and as illustrated by FIG. 2A, the sliding door 130 can include an end cap 135 coupled to a corner or end of the sliding door 130. In turn, the end cap 135 can include the receiving channel 136 formed therein. As is further illustrated by FIG. 2A, the receiving channel 136 can include chamfered or radiused edges 137 to help guide a pin 138 or other protrusion into engagement within the receiving channel 136. For example, radiused or chamfered edges provide a larger initial opening of the receiving channel 136 for easily receiving the pin 138. The radiused or chamfered edges can then gradually narrow to the ultimately desired width of the receiving channel 136, thereby guiding the pin 138 into engagement with the receiving channel 136.

Figure 2B:
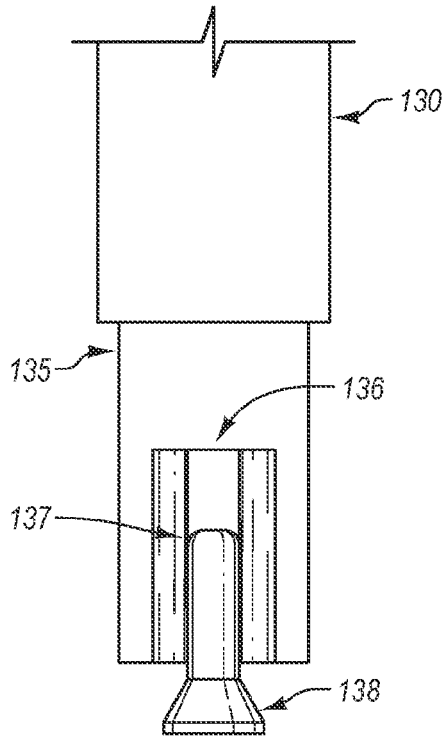
FIG. 2B illustrates a second step of the operation of a locking system in accordance with an implementation of the present disclosure.

FIG. 2B illustrates the pin 138 in alignment to engage the receiving channel of the sliding door 130. As is illustrated, the exterior dimensions of the pin 138 can be similar to the interior dimensions of the receiving channel 136. For example, the outside diameter and height of the pin 138 can be similar, albeit smaller than, the width and height of the receiving channel 136. As a result, the pin 138 and receiving channel 136 can securely interface together to secure the position of the sliding door 130.

Figure 2C:
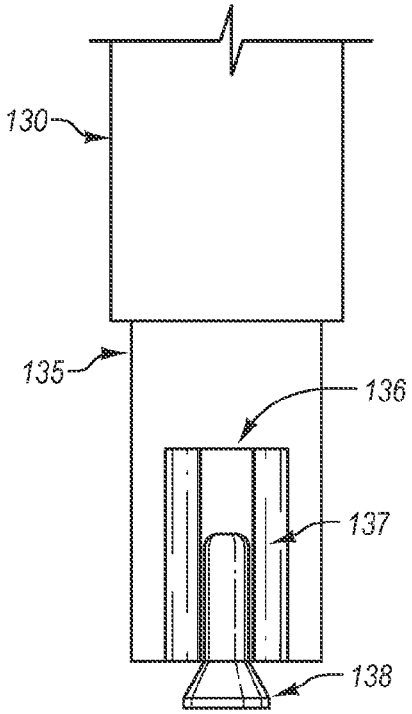
FIG. 2C illustrates a third step of the operation of a locking system in accordance with an implementation of the present disclosure.

Thereafter, and as illustrated in FIG. 2C, a user can slide the sliding door 130 forward such that the pin 138 engages the receiving channel 136. In at least one implementation, the pin 138 engages the receiving channel 136 when the door has reached its fully closed position.

Figure 2D:
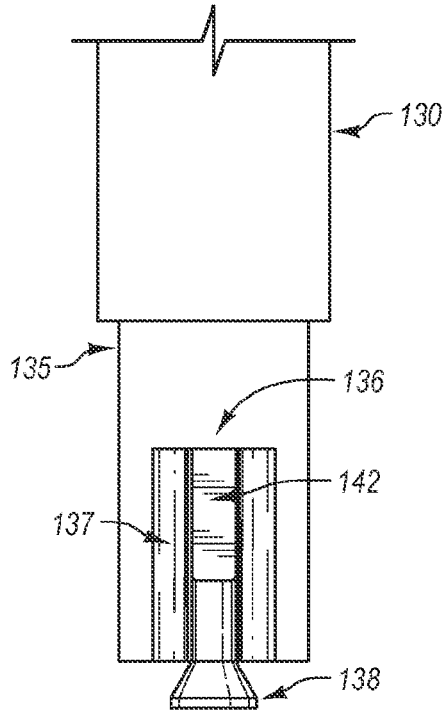
FIG. 2D illustrates a final step of the operation of a locking system in accordance with an implementation of the present disclosure.

As illustrated by FIG. 2D, once the receiving channel 136 receives the pin 138, a user can activate the locking mechanism (e.g., 140, FIG. 1) to capture the pin 138 and secure the sliding door 130. In particular, the user can activate the locking mechanism (e.g., 140, FIG. 1) causing a shaft 142 to drop down and capture the pin 138 within the receiving channel 136. By capturing the pin 138 within the receiving channel 136, the locking mechanism (e.g., 140, FIG. 1) can secure the sliding door 130 in a closed position.

In at least one implementation, and referring again to FIG. 1, a manufacturer can locate the operating means of components of the locking mechanism 140 near a location common for locating a handle or door pull 132 to facilitate operation of the locking mechanism 140 by a user. For example, the locking mechanism 140 can include a standard and commonly available component such as a pin tumbler lock 141 located near the door pull 132. In at least one implementation, the pin tumbler lock 141 of the locking mechanism 140 can include an asymmetrical cam for driving additional components of the locking mechanism 140.

In particular, a manufacturer can couple the pin tumbler lock 141 of the locking mechanism 140 to a tie rod (not shown) extending from the pin tumbler lock 141 to the receiving channel 136. In at least one implementation, the sliding door 130 can include a cavity extending from the pin tumbler lock 141 to the receiving channel 136, through which the tie rod can pass. As previously mentioned, in at least one implementation, the sliding door 130 can include multiple receiving channels 136 configured to receive multiple pins 138. In such a case, the sliding door 130 can further comprise multiple cavities extending from the pin tumbler lock 141 to the receiving channels 136. In turn, the locking mechanism 140 can include multiple tie rods extending through the cavities to the receiving channels 136.

As a result, an assembler can further couple a tie rod to a shaft 142 for driving the shaft 142. In at least one implementation, the shaft 142 has a hexagonally-shaped cross section and includes threading at one end for attachment to the tie rod. The hexagonally-shaped cross section of the shaft 142 allows a manufacturer to configure the shaft 142 so that a flat, rather than rounded, surface of the shaft 142 interfaces with the pin 138 to securely capture the pin 138 within the receiving channel 136. Furthermore, a manufacturer can configure the shaft 142 to pass through a hexagonally-shaped housing or hole (not shown) so as to maintain the orientation of the shaft 142 with respect to the receiving channel 140 and pin 138.

Accordingly, a user can operate the pin tumbler lock 141 of the locking mechanism 140 to drive the tie rod, which in turn drives the shaft 142. By so doing, the user is able to capture and release a pin 138 within the receiving channel 136. As previously discussed, this allows the user to secure and release the sliding door 130 in an easy, reliable, and efficient manner.

FIG. 1 also illustrates a system for sealing a sliding door 130 in a modular wall system. For example, FIG. 1, the system can include one or more gasket seals 129 for reducing/blocking the amount of light and sound passing through the doorway 120 when the sliding door 130 is in a closed position. In particular, a manufacturer can configure the gasket seal 129 to seal a gap between the sliding door 130 and other components, such as the modular wall 110. As shown in FIG. 1, an assembler can include the seal 129 along the entire height of the modular wall 110 to provide a seal along the full height of the sliding door 130. In at least one implementation, the system can also include a gasket seal 129 on each side of a doorway 120 so as to seal gaps on both sides of the sliding door 130.

Figure 3:
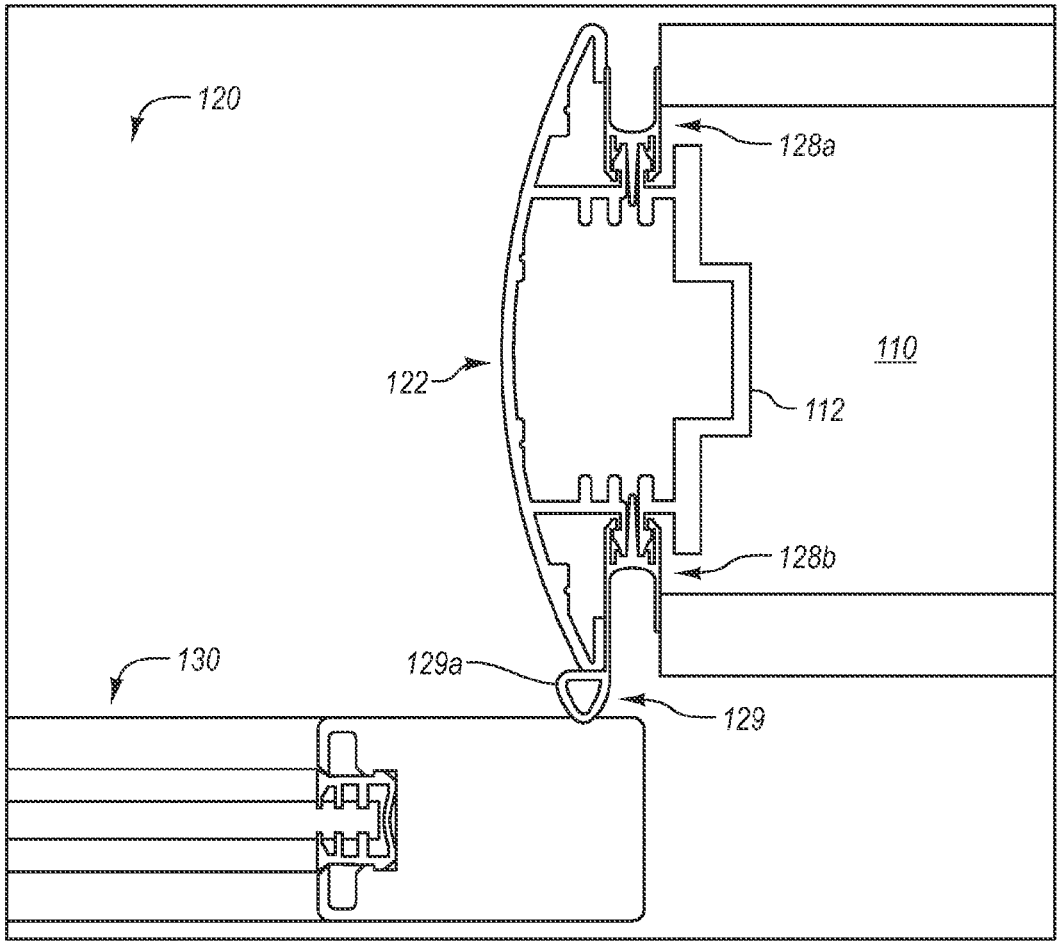
FIG. 3 illustrates a partial cross sectional view of a sealing system in accordance with an implementation of the present disclosure.

These and other components/mechanisms for sealing the sliding door are shown in greater detail in FIG. 3. FIG. 3 illustrates a partial cross-sectional view of a sliding door 130 in sealing contact with a modular wall 110. In particular, FIG. 3 illustrates the edge of a modular wall 110 where the modular wall 110 meets a doorway 120. As shown, the sliding door 130 defines a transverse gap between the modular wall 110 and the sliding door 130. Specifically, the gap is perpendicular to the direction of travel of the sliding door 130.

As further illustrated by FIG. 3, an assembler can couple vertical trim 122 to the edge of the modular wall 110 for improving the aesthetics of the doorway 120. Specifically, an assembler can connect the vertical trim 122 to the modular wall 110 using one or more connectors 128*a-b* (or "connecting extrusions"). In at least one implementation of the present invention, a manufacturer can configure the connectors 128*a-b* to engage with a standard detail on a connection plate 112 of the modular wall 110, and with a similar detail on the vertical trim 122.

One will appreciate that the connection plate 112 can be an integrated part of the modular wall 110, or can be a separate component. In at least one implementation of the present invention, the connection plate 112 extends along the full height of the modular wall 110 and/or doorway 120.

In general, a manufacturer/assembler can repeat the connection of the connection plate 112 of the modular wall 110 and the vertical trim 122 multiple times from the bottom to the top of the modular wall 110, depending on the height of the modular wall 110 and/or the need for stability. In at least one implementation, a manufacturer/assembler can continuously connect the connectors 128 to the connector plate 112 and/or the vertical trim 122 along the full height of the modular wall 110.

After coupling a sliding door 130 to the doorway 120, as illustrated by FIG. 3, the manufacturer/assembler can then seal the gaps between the modular wall 110 and sliding door 130 for various privacy concerns, such as light and sound, in any number of ways. As shown in FIG. 3, the manufacturer/assembler can include a gasket seal 129 to seal the gap between the sliding door 130 and the modular wall 110 when the door is in a closed position. As a result, the manufacturer/assembler can provide an acoustical and/or light seal between the modular wall 110 and the sliding door 130 as desired.

As further illustrated by FIG. 3, the gasket seal 129 can be integrated into one of the connectors (e.g., 128*b*). By integrating the gasket seal 129 into an already necessary part, such as the connector 128*b*, a manufacturer can reduce the number of parts necessary to assemble the system while still providing an acoustical and/or light seal around the sliding door 130. In addition, by locating the gasket seal 129 in a non-obtrusive location, such as coupled directly to the modular wall 110 rather than directly to the sliding door 130, the manufacturer/assembler can provide the acoustical and/or light seal desired while maintaining the aesthetics of the system 100.

Along these lines, FIG. 3 shows that the connector 128*b* can include the integrated gasket seal 129 as an extended feature on one side of the connector 128*b*. Otherwise, connector 128*b* can be similar to standard connector 128*a*. In either case, the gasket seal 129 can include a closed cell portion 129*a* that interfaces with the surface of the sliding door 130 for sealing the gap between the sliding door 130 and the modular wall 110. The closed cell portion 129*a*, which is illustrated as being triangular in FIG. 3, can also be generally circular in shape. Although FIG. 3 only illustrates one side of the doorway 120, one will appreciate that a manufacturer/assembler can install the gasket seal 129 along the vertical edges of the modular wall 110 on both sides of the doorway 120. As a result, the manufacturer/assembler can provide a seal on both sides of the sliding door 130.

In at least one implementation, the material used to manufacture the gasket seal 129 comprises any number of flexible plastic, rubber, or metallic materials. However configured, the manufacturer chooses the flexible material to optimize a seal. For example, the manufacturer can configure the gasket seal 129 to maintain a seal between the modular wall 110 and the sliding door 130 through the sliding door's 130 travel into a closed position. In at least one implementation, a manufacturer can form the gasket seal 129, particularly the closed cell portion 129*a* of the gasket seal 129, using a flexible PVC material, while the connectors 128 are formed using a rigid PVC material.

In addition to the foregoing, implementations of the present invention can also be described in terms of one or more steps in a method of accomplishing a particular result. For example, at least one implementation of the present invention comprises a method of providing a locking and sealing system for a sliding door. This method is described more fully below.

For example, at least one method in accordance with the present invention can comprise an act of determining a doorway to be locked and sealed. This act can include identifying a doorway in a modular wall system. For example, an assembler can identify a doorway 120 in a modular wall 110.

The method can also comprise an act of mounting a sliding door to the doorway. This act can include coupling a sliding door to the doorway, wherein the sliding door is configured to open and close the doorway. In particular the sliding door comprises one or more receiving channels. Each receiving channel is configured to receive a pin extending vertically from a support surface. The sliding door also comprises a locking mechanism configured to selectively drive a shaft to capture and release the pin, when received by the receiving channel, to secure and release the door. For example, an assembler can mount a sliding door 130 to a roller track 126 coupled to the upper portion of the doorway 120, such that sliding the sliding door 130 along the roller track 126 opens and closes the doorway 120. The sliding door 130 can include a receiving channel 136 along a bottom edge of the sliding door 130, configured to receive a corresponding pin 138. The assembler can further include a locking mechanism 140 configured to capture the pin 138 when received by the receiving channel 136 to secure the sliding door 130 in a closed position.

In addition, the method can comprise an act of coupling a pin to a support structure. This act can include attaching a pin to a support surface proximate the doorway, wherein the pin is configured to engage the receiving channel of the sliding door when the sliding door is in a closed position. For example, an assembler can couple the pin 138 to the floor's surface so that it engages the receiving channel 136 when the sliding door 130 is closed.

Furthermore, the method can comprise an act of installing a gasket seal around the doorway. This act can include coupling a gasket seal to a modular wall, wherein the gasket seal is configured to seal one or more transverse gaps between the sliding door and the modular wall when the sliding door is in a closed position. The gaps sealed by the gasket seal are perpendicular to the direction of travel for the sliding door. For example, an assembler can use connector 128*b*, including an integrated gasket seal 129, to couple the vertical trim 122 to the connector plate 112 of the modular wall 110. As a result, the gasket seal 129 can seal the transverse gap between the sliding door 130 and the modular wall 110.

The present invention can be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. In an architectural design environment that includes one or more modular wall systems with at least one sliding door, a locking system configured to secure and release a sliding door, the locking system comprising:

a vertical pin vertically extending from a support surface;

a sliding door comprising an edge having an elongated vertical receiving channel configured so that said vertical pin slides into and is enclosed within said elongated vertical receiving channel when said edge of the sliding door is moved into position over said vertical pin;

a shaft configured for vertical movement within said elongated vertical receiving channel; and a locking mechanism configured to selectively lock and unlock said vertical pin within said elongated vertical receiving channel by vertically moving said shaft into engagement over said vertical pin when locking the sliding door, and by vertically moving said shaft so that said vertical pin is withdrawn from the shaft when unlocking the sliding door.

2. The system as recited in claim 1, wherein said edge of the sliding door is a leading edge and wherein said vertical pin and elongated vertical receiving channel are configured to secure the sliding door in a closed position.

3. The system as recited in claim 1, wherein said elongated vertical receiving channel comprises a vertical slot that forms an opening that includes chamfered edges, wherein the chamfered edges facilitate receiving said vertical pin within said elongated vertical receiving channel when the elongated vertical receiving channel slides over the vertical pin.

4. The system as recited in claim 1, wherein the sliding door further comprises an end cap positioned at said edge of the sliding door, wherein the elongated vertical receiving channel is formed in said end cap.

5. The system as recited in claim 1, wherein said elongated vertical receiving channel is located in a bottom portion of said edge of the sliding door and said vertical pin extends vertically upward from a said support surface, which is comprised of a floor.

6. In an architectural design environment that includes one or more modular wall systems with at least one sliding door, a sealing system configured to seal a gap between a sliding door and a modular wall panel or door frame, the sealing system comprising:

a modular wall including a doorway;

a vertical trim member;

one or more connectors attaching said trim member to said modular wall at either side of said doorway;

a sliding door coupled to the modular wall and configured to open and close the doorway, wherein the sliding door defines at least one gap between the sliding door and the modular wall that is perpendicular to the direction of travel for the sliding door; and at least one of said one or more connectors comprising an integral gasket seal configured to seal the gaps between the modular wall and the at least one sliding door.

7. The system as recited in claim 6, wherein the integral gasket seal of said at least one or more connectors is located on a side of said doorway which corresponds to a closed position of the sliding door.

8. The system as recited in claim 7, wherein said at least one or more connectors and the integral gasket seal are formed using different materials.

9. In an architectural design environment that includes one or more modular wall systems with at least one sliding door, a locking system configured to secure and release a sliding door, the locking system comprising:

a vertical pin vertically extending from a support surface, the vertical pin corresponding to either a closed door or an open door position;

a sliding door comprising an elongated vertical receiving channel located in either a leading edge or a trailing edge of the sliding door, the elongated vertical receiving channel being configured so that said receiving channel slides into position over said vertical pin when the sliding door is in at least one of the open or closed door positions;

a shaft configured for vertical movement within said receiving channel; and a locking mechanism configured to selectively lock and unlock said vertical pin within said receiving channel by vertically moving said shaft into engagement over said vertical pin when locking the sliding door, and by vertically moving said shaft so that said vertical pin is withdrawn from the shaft when unlocking the sliding door.

10. The system as recited in claim 9, wherein said edge of the sliding door is a leading edge and wherein the vertical pin and receiving channel are configured to secure the sliding door in a closed position.

11. The system as recited in claim 9, wherein the receiving channel comprises a vertical slot that forms an opening that includes chamfered or radiused edges, wherein the chamfered or radiused edges facilitate receiving said vertical pin within the receiving channel when the receiving channel slides over the vertical pin.

12. The system as recited in claim 11, wherein the sliding door further comprises an end cap positioned at said leading edge of the sliding door, wherein the receiving channel is formed in said end cap.

13. The system as recited in claim 12, wherein said receiving channel is located in a bottom portion of said leading edge of the sliding door and said vertical pin extends vertically upward from a floor, which serves as said support surface.

* * * * *

UNITED STATES PATENT AND TRADEMARK OFFICE

CERTIFICATE OF CORRECTION

PATENT NO. : 8,112,954 B2
APPLICATION NO. : 12/135027
DATED : February 14, 2012
INVENTOR(S) : Gosling et al.

It is certified that error appears in the above-identified patent and that said Letters Patent is hereby corrected as shown below:

Column 2
Line 39, change “these” to --there--

Column 3
Line 20, change “on” to --one--
Line 52, change “considered to be” to --considered--

Column 5
Line 25, change “itself” to --itself.--

Column 9
Line 35, change “roller” to --mounting--
Line 37, change “roller” to --mounting--

Column 10
Line 62, change “gaps” to --gap--

Signed and Sealed this
Sixteenth Day of October, 2012

David J. Kappos

David J. Kappos
*Director of the United States Patent and Trademark Office*